US009196216B2

(12) United States Patent
Yu et al.

(10) Patent No.: US 9,196,216 B2
(45) Date of Patent: Nov. 24, 2015

(54) FRAME BUFFER MANAGEMENT AND SELF-REFRESH CONTROL IN A SELF-REFRESH DISPLAY SYSTEM

(71) Applicants: Qing Yu, Santa Clara, CA (US); Jieyang Xu, Shanghai (CN); Ding Lu, San Jose, CA (US)

(72) Inventors: Qing Yu, Santa Clara, CA (US); Jieyang Xu, Shanghai (CN); Ding Lu, San Jose, CA (US)

(73) Assignee: Parade Technologies, Ltd., George Town, Grand Cayman (KY)

( * ) Notice: Subject to any disclaimer, the term of this patent is extended or adjusted under 35 U.S.C. 154(b) by 372 days.

(21) Appl. No.: 13/705,098

(22) Filed: Dec. 4, 2012

(65) Prior Publication Data

US 2013/0147822 A1 Jun. 13, 2013

Related U.S. Application Data

(60) Provisional application No. 61/568,072, filed on Dec. 7, 2011.

(51) Int. Cl.

| | |
|---|---|
| ***G09G 5/36*** | (2006.01) |
| ***G09G 5/00*** | (2006.01) |
| ***G09G 5/393*** | (2006.01) |
| ***G09G 5/395*** | (2006.01) |

(52) U.S. Cl.

CPC ..... *G09G 5/001* (2013.01); *G09G 5/393* (2013.01); *G09G 5/395* (2013.01); *G09G 2360/12* (2013.01); *G09G 2360/18* (2013.01)

(58) Field of Classification Search

CPC ... G09G 5/393; G09G 5/395; G09G 2310/04; G09G 2320/103; G09G 2360/12; G09G 2360/127; G09G 5/39; G09G 3/1415

See application file for complete search history.

(56) References Cited

U.S. PATENT DOCUMENTS

| | | | | |
|---|---|---|---|---|
| 5,742,788 | A * | 4/1998 | Priem et al. | 711/110 |
| 6,559,896 | B1 | 5/2003 | Zwartenkot et al. | |
| 8,933,951 | B2 * | 1/2015 | Nath et al. | 345/545 |
| 2006/0146056 | A1 * | 7/2006 | Wyatt | 345/501 |
| 2008/0174540 | A1 | 7/2008 | Lee | |
| 2010/0123727 | A1 | 5/2010 | Kwa et al. | |

(Continued)

FOREIGN PATENT DOCUMENTS

| | | | |
|---|---|---|---|
| CN | 101231835 | A | 7/2008 |
| EP | 1640966 | A1 | 3/2006 |

(Continued)

OTHER PUBLICATIONS

European Patent Office, Extended European Search Report, European Patent Application No. 12196153.6, Mar. 20, 2013, 8 Pages.

(Continued)

*Primary Examiner* — Hau Nguyen
(74) *Attorney, Agent, or Firm* — Fenwick & West LLP

(57) ABSTRACT

A system and method are disclosed is to prevent the screen tearing in a video display system with self-refresh features while limiting space used for memory size in the self-refreshing sink device. A flexible method is utilized to manage a frame buffer and control self-refresh display timing to prevent screen tearing. The sink device has capabilities including one or more of self-refreshing and applying single frame updates as well as burst single frame updates while self-refresh is active. The memory utilized by the frame buffer during self-refresh is limited to less than that needed to store two full frames of video.

20 Claims, 14 Drawing Sheets

(56) References Cited

U.S. PATENT DOCUMENTS

| | | | | |
|---|---|---|---|---|
| 2010/0128044 | A1 | 5/2010 | Yu | |
| 2012/0075188 | A1* | 3/2012 | Kwa et al. | 345/168 |

FOREIGN PATENT DOCUMENTS

| | | | |
|---|---|---|---|
| JP | 11-296155 | A | 10/1999 |
| TW | 201020791 | A | 6/2010 |

OTHER PUBLICATIONS

Wiley, C., Vesa, eDP™, Embedded DisplayPort™, "The New Generation Digital Display Interface for Embedded Applications," DisplayPort Developer Conference, Dec. 6, 2010, Westin Taipei, XP002693420, 30 Pages.

Chinese First Office Action, Chinese Application No. 201210529882.1, Sep. 2, 2014, 22 pages.

Chinese Second Office Action, Chinese Application No. 201210529882.1, Jul. 1, 2015, 8 pages.

* cited by examiner

FRAME BUFFER MANAGEMENT AND SELF-REFRESH CONTROL IN A SELF-REFRESH DISPLAY SYSTEM

CROSS REFERENCE TO RELATED APPLICATIONS

This application claims the benefit of, and priority to, U.S. Provisional Application No. 61/568,072, filed Dec. 7, 2011, which is incorporated by reference in its entirety.

BACKGROUND

1. Field of the Art

The disclosure generally relates to a video display system. More specifically, the disclosure relates to a self-refresh feature in video receivers and display timing controllers.

2. Description of the Related Art

In many video display systems, a page flipping method is utilized to prevent screen tearing. A frame buffer uses a first section of memory to display a current frame. While the data in that memory is being displayed, a second section of memory is filled with data for the next frame. Once the second section of memory is filled, the frame buffer is instructed to look at the second section of memory and display that data. The process continues with the next video frame being loaded into memory in the first section of memory. This ensures that a frame of video is always fully loaded before displaying the frame. For this to be accomplished, memory capable of storing two entire frames of video must be available to a display system.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

DETAILED DESCRIPTION

The Figures (Figs.) and the following description relate to preferred embodiments by way of illustration only. It should be noted that from the following discussion, alternative embodiments of the structures and methods disclosed herein will be readily recognized as viable alternatives that may be employed without departing from the principles of what is disclosed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Figure 1:
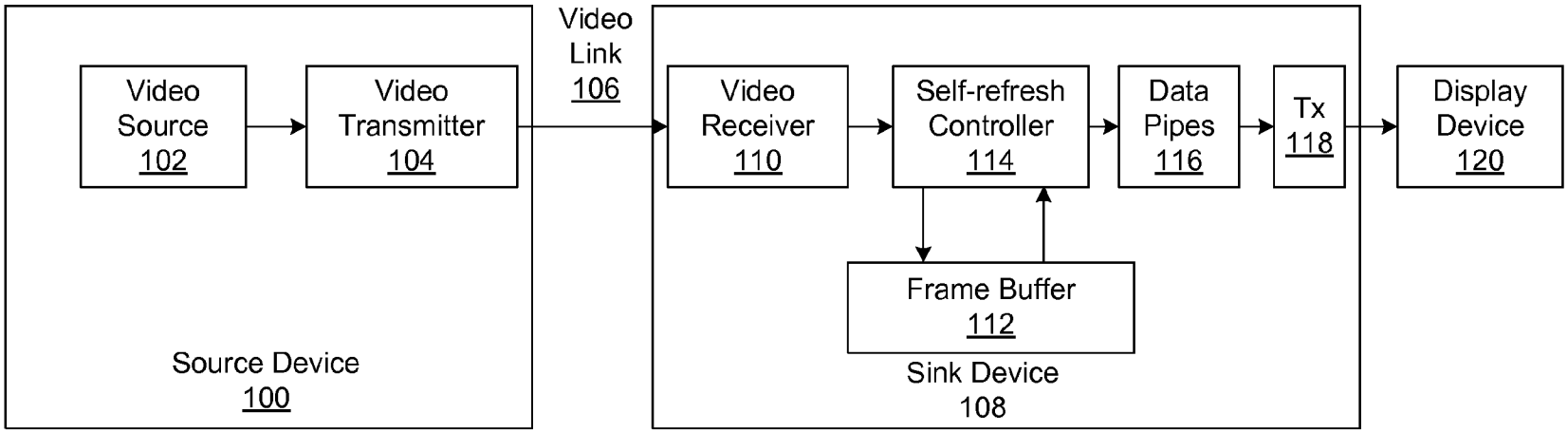
FIG. 1 illustrates a self-refresh display system according to one embodiment.

FIG. 1 illustrates a self-refresh display system in accordance with one embodiment. A self-refresh display system is a system for displaying video streams from a source device 100. The system includes a source device 100 and a sink device 108 that are communicatively coupled with a video link 106. The sink device 108 is communicatively coupled to a display device 120. The source device 100 comprises, for example, a personal computer, DVD player, set-top-box, laptop, video game console, tablet computer, smart phone or other similar devices. The source device 100 includes a video source 102 and a video transmitter 104. The video source 102 may be, for example, a video stored on a disk, stored on a hard drive, or streamed over a network. The video transmitter 104 is configured to encode or otherwise prepare the video in the video source 102 for transmission to the sink device 108. The video link 106 is a cable, wireless interface, or other connection between the source device 100 and the sink device 108. In one embodiment, the video link includes a video transmitter, video receiver and link media. Link media that may be included in such a video transport system are DVI, LVDS, HDMI and DISPLAYPORT. The sink device 108 includes a video receiver 110, a frame buffer 112, a self-refresh controller 114, data pipes 116 and a transmitter 118. The video receiver 110 is communicatively coupled to the self-refresh controller 114. The self-refresh controller is communicatively coupled to the frame buffer 112 and the data pipes 116. The data pipes 116 are communicatively coupled to the transmitter 118 and the transmitter 118 is communicatively coupled to the display device 120.

The display device 120 may be a liquid crystal display (LCD), light emitting diode (LED) or plasma based display, or another screen suitable for video display. A sink device 108 is configured to receive a plurality of video frames over the video link 106 and implement a self-refresh feature. In one embodiment, the sink device 108 is part of the display device 120. The sink device 108 may also be external from the display device 120. The video receiver 110 is configured to receive the plurality of video frames transmitted over the video link 106 and perform any processing to enable processing within the sink device 108. The self-refresh controller 114 is configured to display an image or series of images continuously on the display device 120. The frame buffer 120 is used to support the self-refresh feature. The sink device 108 stores a static image locally in the frame buffer 112 and displays the saved frame from the frame buffer while the video source and/or video link are disable and/or turned off to save power. The data pipes 116 may be a video or display processing unit such as timing controller data pipes. The transmitter 118 is, in one example embodiment, a low voltage differential signaling (LVDS) transmitter or similar panel interface transmitter.

The Self-refresh features include the following functions:

Self-refresh (SR) entry: Source device 100 instructs the sink device 108 to enter a SR active state. Sink device 108 captures a static frame from the video link to frame buffer and sink device 108 switches to locally regenerated timings and display video frame from frame buffer.

Self-refresh (SR) exit: Source device 100 instructs the sink device 108 to transition SR state from active to inactive. Sink device 108 device continues to drive display on locally generated timings until timing re-synchronization is completed. When re-sync is completed, sink device 108 drives display on source timings and displays video frames as they are received from the source device 100.

Single Frame Update: A source will transmit a static frame to update the frame buffer without exiting SR active state. The source will send new static video frame on the video link. A sink captures the new static video frame to a frame buffer. The sink continues driving a display on locally generated timings and displays the newly received single frame utilizing the self-refresh controller.

Burst Single Frame Update: The single frame update mechanisms can be extended to multiple consecutive frames. A source may send single frame updates for multiple consecutive frames to achieve burst single frame updates without exiting SR active state Each of the single frames received during the burst single frame update is then displayed and self-refreshed until a subsequent frame of the burst single frame update is received.

For the above single frame updates and burst single frame updates, screen tearing can occur if special care is not taken for frame buffer management. Screen tearing is a visual artifact in a video where partial information from two or more different frames is shown in a display device in a single screen display.

One example of a system configured for self-refresh includes some embodiments of embedded DisplayPort implementations. The disclosed system and method also apply to any other digital video display receivers which have similar self-refresh function built-in. The system limits the size of memory needed to prevent screen tearing. Locally generated timing adjusts to balance throughput between video data flow on a video link and display data flow with self-refresh to prevent memory over-run or under-run.

Figure 2:
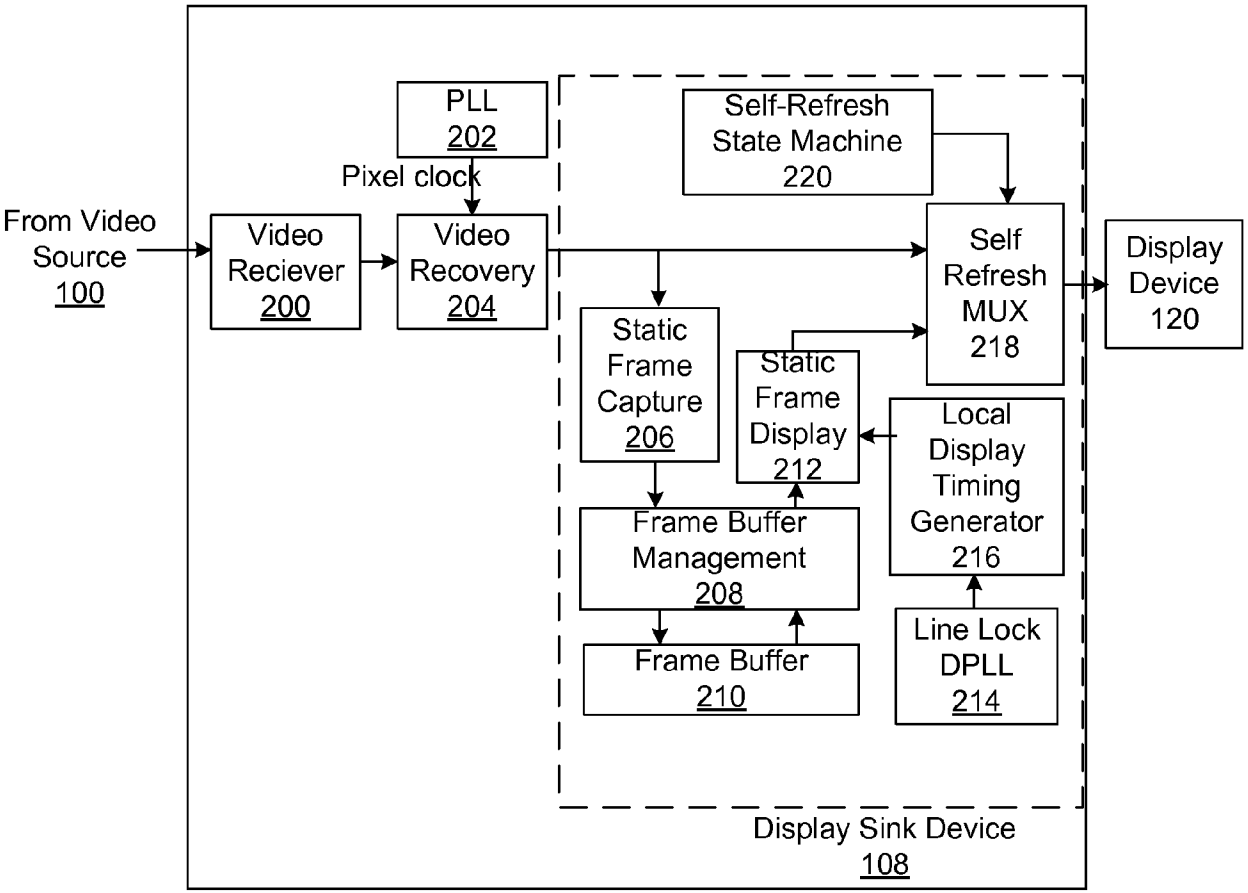
FIG. 2 illustrates a display sink device according to one embodiment.

FIG. 2 illustrates a display sink device 108 according to one example embodiment. The display sink device includes a phase-locked loop 202, video receiver 200, video recovery block 204, static frame capture module 206, frame buffer management module 208, frame buffer 210, static frame display 212, line lock DPLL module 214, local display timing generator 216, self refresh MUX 218 and self-refresh state machine 220. The display sink device 108 is communicatively coupled to a video source 100 and display device 120. Video receiver 200 is configured to receive the video frames transmitted from video source 100. Video recovery block 204 is used to recover video data and timing information from the video source and pass video data and timing information to the self-refresh controller. The PLL 202 is a phase-locked loop that can be used for pixel clock recovery by the video recovery block 204.

Static frame capture 206 is configured to receive and capture a static frame recovered by the video recovery block 204 and write the frame to frame buffer 210. The frame buffer management module 208 governs writes to and accesses from the frame buffer 210. Frame buffer management will manage write and read addresses within the frame buffer 210 to prevent screen tearing for single frame update or burst frame update while in self-refresh active state. Static frame display 212 is used to retrieve a static frame from the frame buffer 210. Line lock DPLL 214 generates a self-refresh line clock. The self-refresh line clock is adjusted so that the frame read throughput will match the frame write throughput to prevent frame buffer over-run or under-run during single frame update or burst frame update while in self-refresh active state.

Local display timing generator 216 generates displaying timing information for self-refresh and the timing information is locked to the self-refresh line clock generated by the line clock DPLL 214. Self-Refresh MUX 218 is used to select video data and video timing source. It may select video data and timing from the video recovery block 204 to display frames as they are received from the video source 100 or from the static frame display block 212 to display frames that are being self-refreshed.

Figure 3:
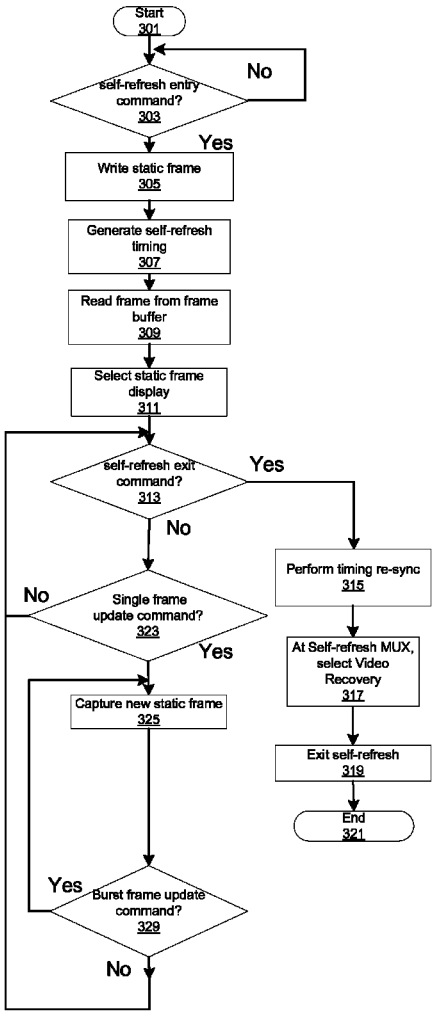
FIG. 3 illustrates a flow chart for controlling a self-refresh state according to one embodiment.

FIG. 3 illustrates a flow chart for controlling a self-refresh state machine in accordance with one embodiment. Before self-refresh is entered, mux 218 selects video input from the video recovery module 204 to display frames as they are received from the video source 100. When a self-refresh entry command is received 303, the current frame is written 305 to the frame buffer 210 as a static frame. When the static frame capture is completed, line lock DPLL is set to coast mode and the local timing generator 216 is instructed to generate 307 self refresh timings. The static frame is read 309 from the frame buffer 210 and transmitted for display. The mux 218 selects 311 video input from the static frame display module 212 to display the static frame that is being self-refreshed until another command is received. When a self refresh exit command is received 313, the system performs a timing re-sync 315 to synchronize with source device 100 generated timings rather than locally generated timings. When the re-sync is completed, the mux 218 is configured 317 to display video received at the video recovery module 204. Self-refresh mode is then exited 319 and the system waits for another self-refresh entry command at start 301.

If no self-refresh exit command is received 313, the system continues to display the static image while also detecting any single frame update command that is received 323. If the single frame update command is received, the line lock DPLL is set to sync mode and the new static frame is captured 325. The new static frame is appended to the previous static frame in memory. If another single frame update is received as part of a burst frame command 329, the system returns to block 325 to capture the additional static frame module for display. When no additional single frame updates are received, the system returns line lock DPLL to coast mode and again waits for a self-refresh exit 319 or single frame update command.

Self-Refresh Frame Buffer Management

In one embodiment, the frame buffer 210 is used as a first in first out (FIFO) buffer. The size of the frame buffer is a larger than one frame. For example, the memory size can be chosen as follows:

Frame Buffer Size=1−frame size+extra buffer size

Extra buffer size=2 or more lines.

Figure 4:
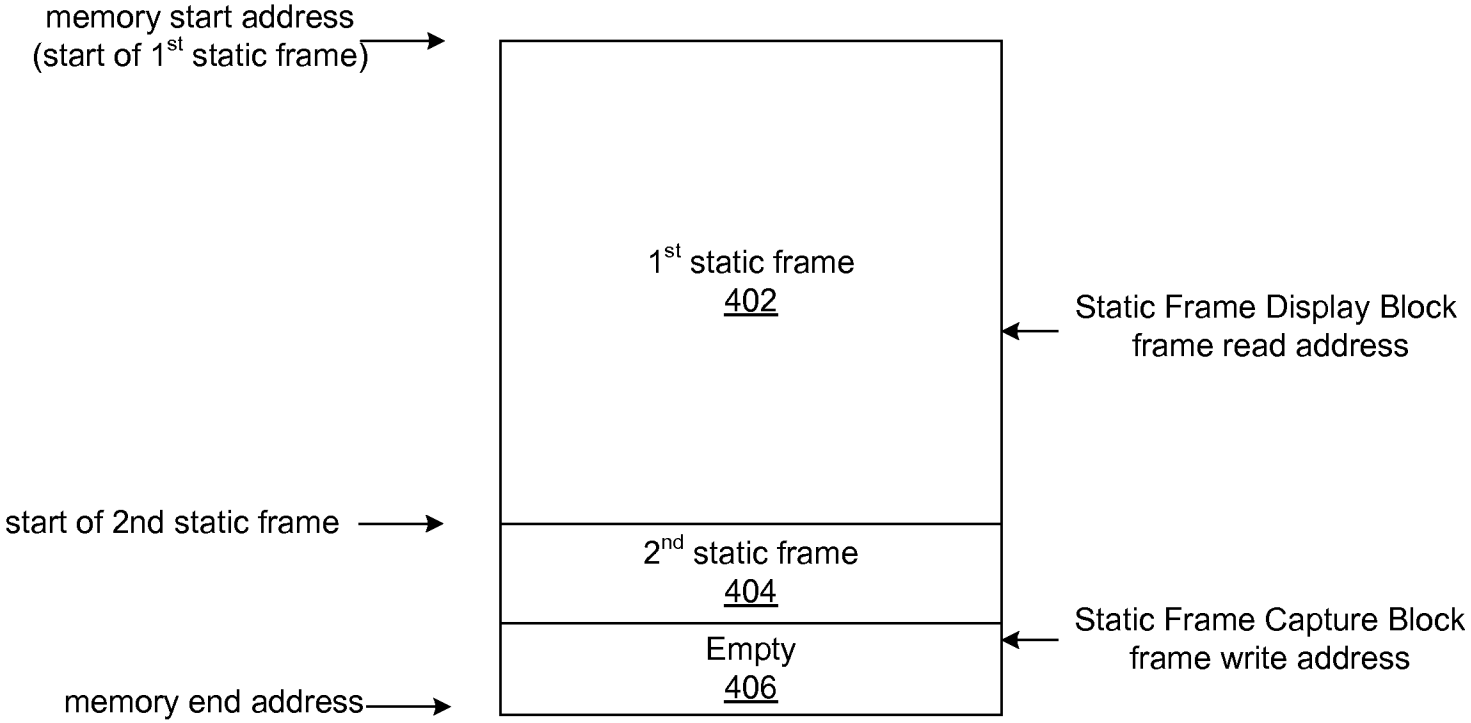
FIGS. 4 and 5 illustrate frames stored in a frame buffer according to one embodiment.
Figure 5:
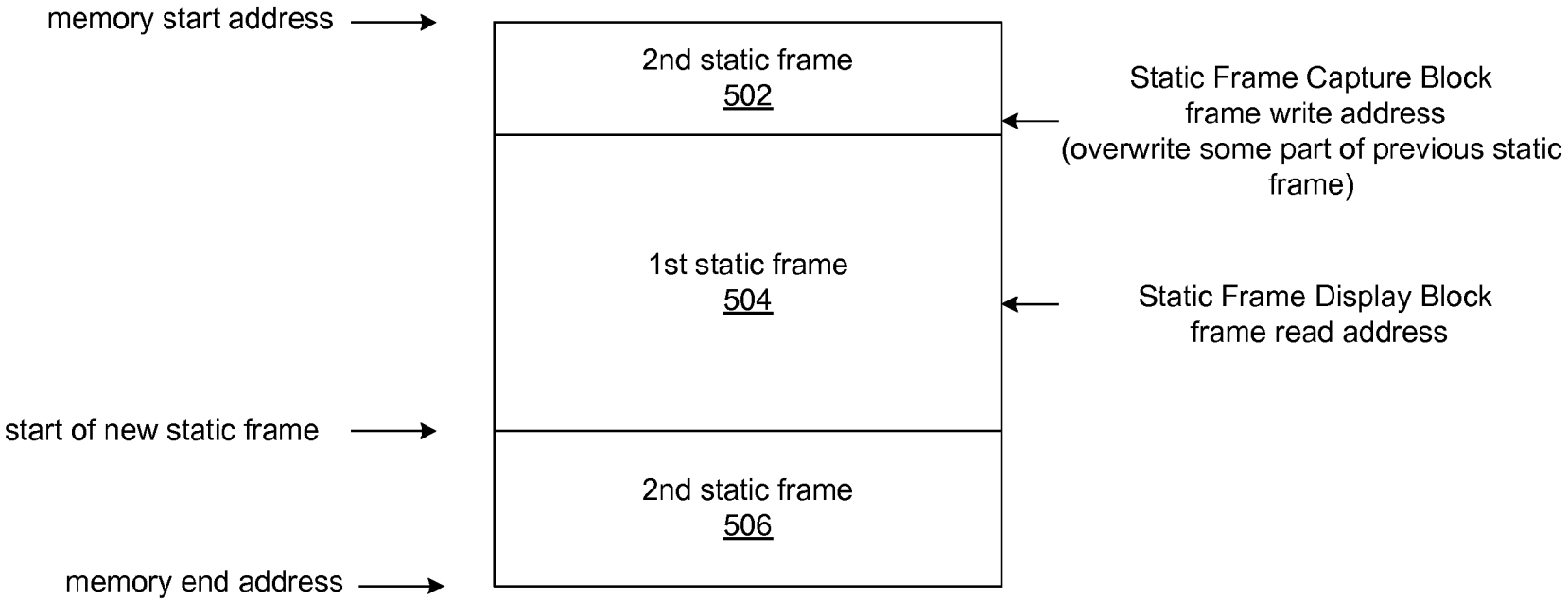

FIG. 4 and FIG. 5 illustrate frames stored in a frame buffer in accordance with one embodiment. From these figures, examples are illustrated of avoidance of overlap with extra buffer in the memory.

For static frame display, in one embodiment a frame image is retrieved from the memory location for the previous static frame. For static frame capture, when a second ($2^{nd}$) static frame is written to the frame buffer, the new static frame is appended to the end of the previous static frame. For a frame buffer write, when the memory end address is reached, the memory address is wrapped to the memory start address and some part of the previous static frame begins to be overwritten. The overwritten portion has already been displayed and will not be used in the future. The static frame display block will display from the new static frame for the next display frame.

FIG. 4 illustrates a first ($1^{st}$) static frame 402 which has been completely written to the frame buffer. In other memory locations, a $2^{nd}$ static frame 404 is being written to the frame buffer. Empty memory 406 has not yet been written with any frame data. FIG. 5 illustrates the empty data 406 being written with additional lines of the $2^{nd}$ static frame in section 506. Section 506 of FIG. 5 comprises sections 404 and 406 of FIG. 4. The $2^{nd}$ static frame writing has wrapped around to the beginning memory locations of the frame buffer and the beginning portion of the $1^{st}$ static frame has been overwritten in portion 502 with lines of the $2^{nd}$ static frame. More of the $1^{st}$ static frame in section 504 will be overwritten as the remainder of the $2^{nd}$ static frame is written to the frame buffer. When the $2^{nd}$ static frame is entirely written to the frame buffer, a small portion of the $1^{st}$ static frame will remain in the frame buffer. This remaining portion of the $1^{st}$ static frame is the portion of memory that will be initially overwritten for a third ($3^{rd}$) static frame being written to the frame buffer.

The static frame display block is configured to read a static frame from beginning to end. When the static frame display block reaches the end of a static frame a check is performed to see if a new static frame is written in the frame buffer and how many lines are written in the frame buffer. If there are enough lines written to the frame buffer of the new static frame, the static frame display block can begin to read from the new static frame. If not, the static frame display block again reads from the previous static frame for display. The lines for switching frame read start address are defined in one embodiment as the threshold to switch the frame read start address.

For example, there is n-line in a video frame and the extra buffer needs to save eight lines of video data. Then the memory size needed is n-line+8-line. The threshold for switching memory start address is defined as 4-line. In this case, when the static frame capture starts to write new static frame to frame buffer, the static frame display is displaying video line x from previous static frame. Line x is within 1 to n. If the frame read speed can be kept the same as, or close to, the frame write speed, the frame read address will not cross frame write address and thus the screen tearing will not occur.

Figure 6:
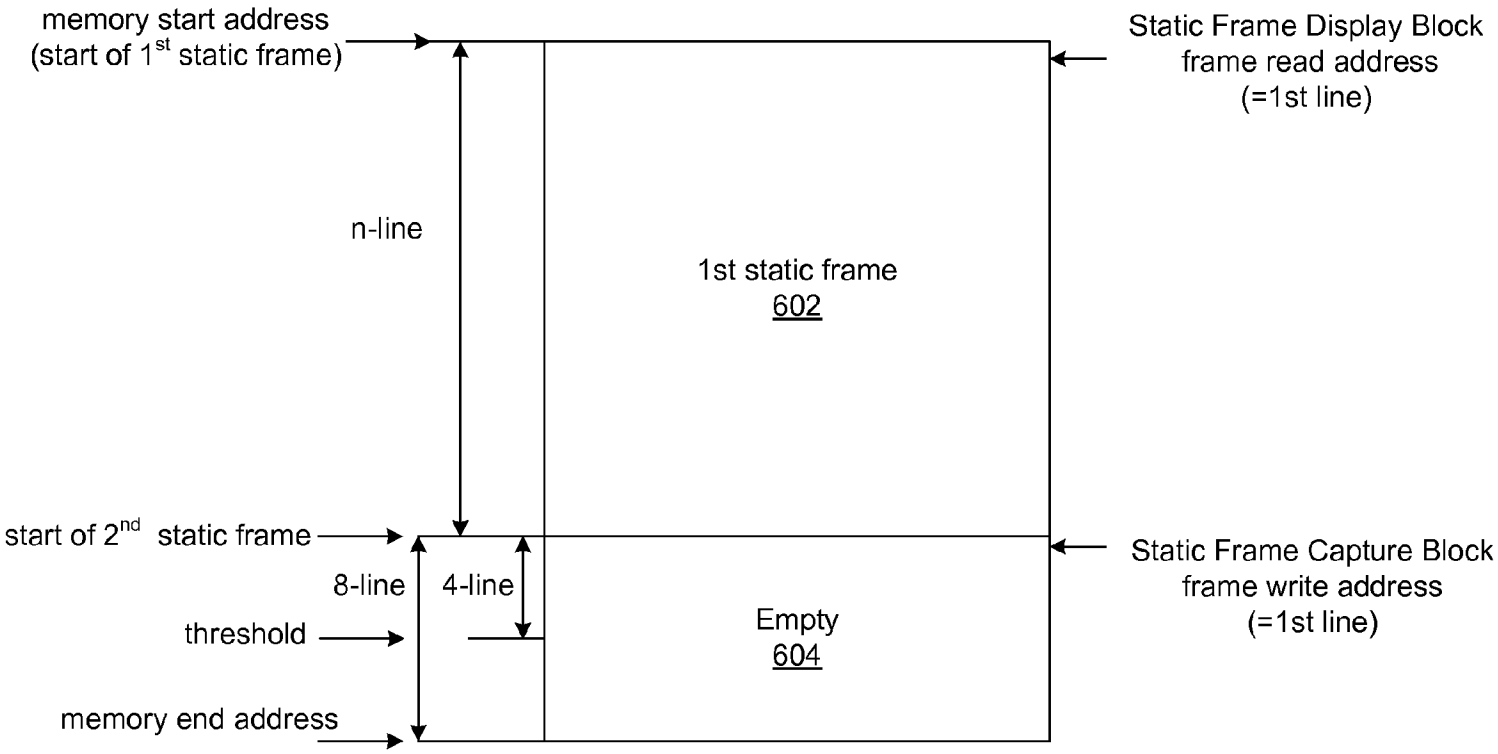
FIG. 6 illustrates beginning to write a new static frame to the frame buffer according to one embodiment.
Figure 7:
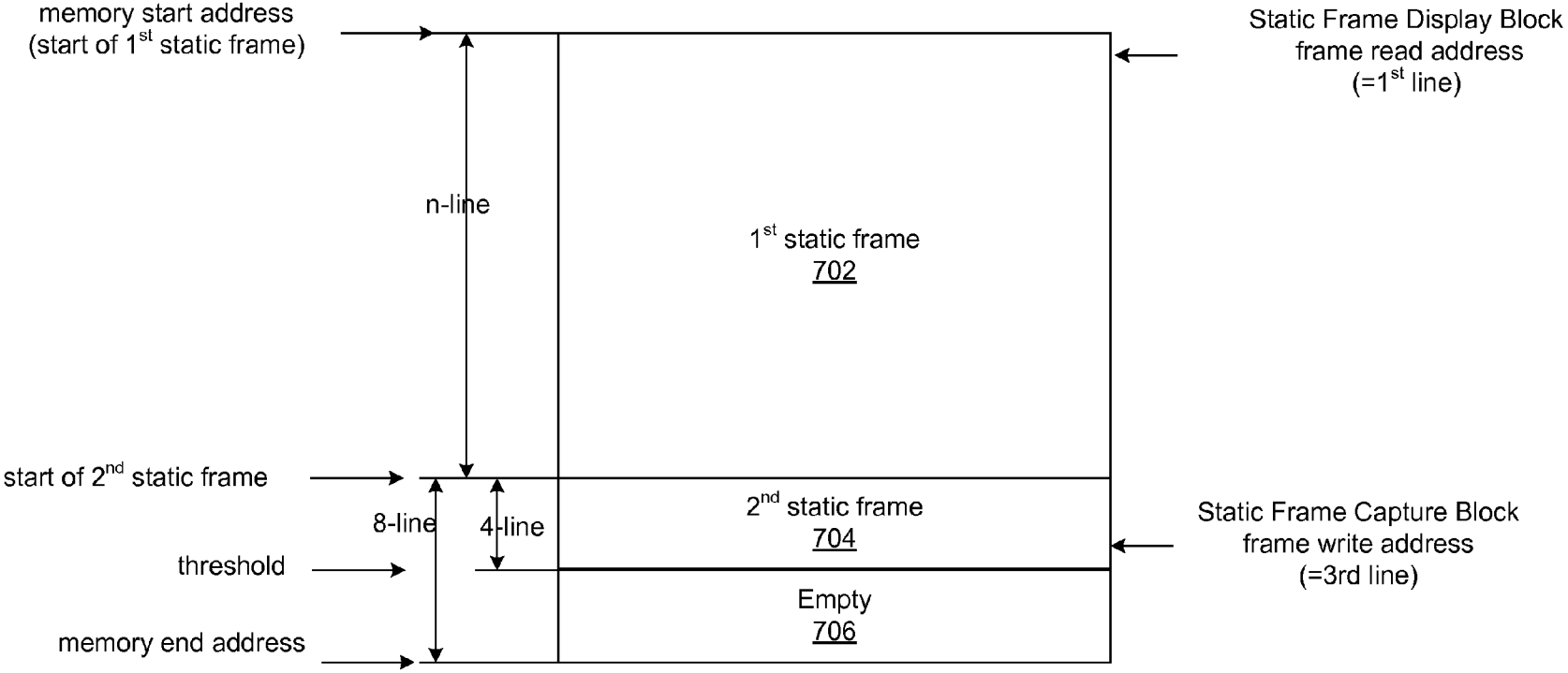
FIG. 7 illustrates repeatedly displaying a previous static frame if a write threshold is not reached according to one embodiment.
Figure 8:
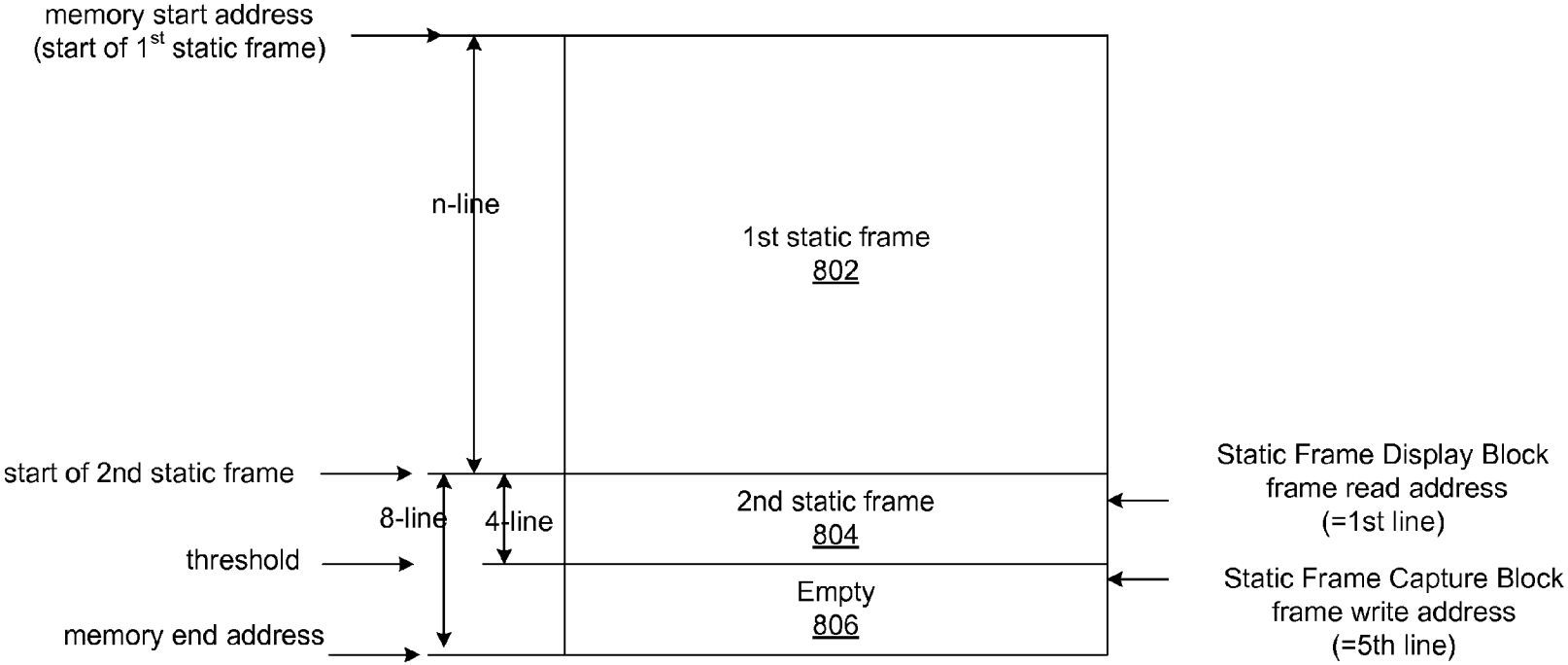
FIG. 8 discloses displaying a new static frame when a write threshold is reached according to one embodiment.

There are three relatively extreme cases for frame buffer writing. FIGS. 6-8 illustrate each of the three extreme cases in accordance with one embodiment.

FIG. 6 illustrates beginning to write a new static frame to the frame buffer according to one embodiment. In FIG. 6, when the static frame capture writes the 1st line of the new static frame at the beginning of empty memory locations 604, the static frame display is reading the 1st line of the previous static frame at the beginning of memory locations 602. When the static frame capture wraps the memory write address to the memory start address and writes a ninth ($9^{th}$) line of the new static frame to the $1^{st}$ line of memory, the static frame display is displaying the 9th line of the previous static frame. Therefore, the writing for new static frame will not corrupt previous static frame and screen tearing is prevented.

FIG. 7 illustrates repeatedly displaying a previous static frame if a write threshold is not reached according to one embodiment. In FIG. 7, 3 lines of the $2^{nd}$ static frame have been written to memory locations 704. In this embodiment, 4 lines of a new frame must be written to begin displaying a new static frame. In other embodiments, any number of lines may be used for this write threshold. The static frame display module sequentially processes the lines stored in memory. When the beginning of a new frame is reached, in this case the $2^{nd}$ static frame in 704, the new frame is displayed only if the write threshold is reached. In this case 4 lines of the $2^{nd}$ static frame have not been written, therefore the static frame display module returns to the beginning of the previous static frame, in this case the $1^{st}$ static frame in memory locations 702, and again begins displaying the previous static frame sequentially. When the beginning of the new static frame is again reached, it will be displayed if the write threshold has been reached.

FIG. 8 discloses displaying a new static frame when a write threshold is reached according to one embodiment. In FIG. 8, when static frame display reaches the new $2^{nd}$ static frame at memory locations 804, the static frame capture module is capturing the $5^{th}$ line from the new static frame. As the write threshold of 4 is reached, the static frame display module proceeds with displaying the $2^{nd}$ static frame sequentially, beginning with the first line stored in memory within memory locations 804. The 4 lines stored in the frame buffer between the line being read for display and the line being written to the frame buffer ensure no frame tearing occurs. The process repeats as further frames are received.

Even with extra buffer in the memory, special care may be necessary to avoid overflow or underflow. To avoid overflow and under flow a line lock DPLL to match the static frame display throughput with the static frame capture throughput may be used.

Figure 9:
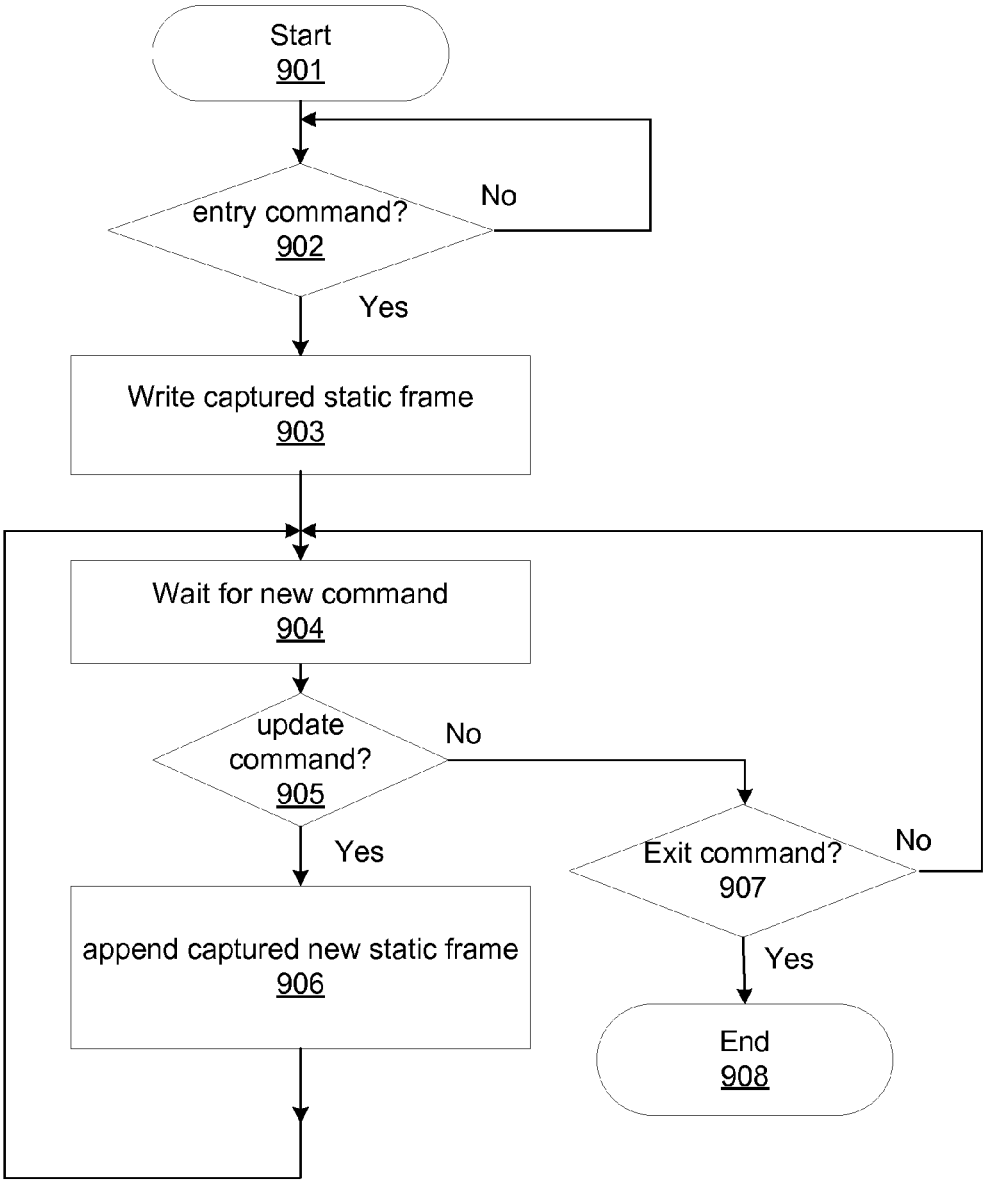
FIG. 9 illustrates a frame buffer write flow chart according to one embodiment.

FIG. 9 illustrates a frame buffer write flow chart in accordance with one embodiment. Upon receiving an entry command 902, the system enters self-refresh active mode and captures 903 a static frame to the frame buffer beginning at a memory start address. Upon completing the capture, the system waits 904 for a new command. If the new command is an exit self-refresh command 907, the loop ends 908 and the system returns to start 901. If the new command is a single or burst frame update command 905, a new static frame is captured 906 and appended to the previously captured static frame in the frame buffer. In the case of a burst command, the received frames are repeatedly captured and appended to the previously captured static frame. At the conclusion of appending captured frames to the frame buffer, the system again waits for new commands 904.

Figure 10:
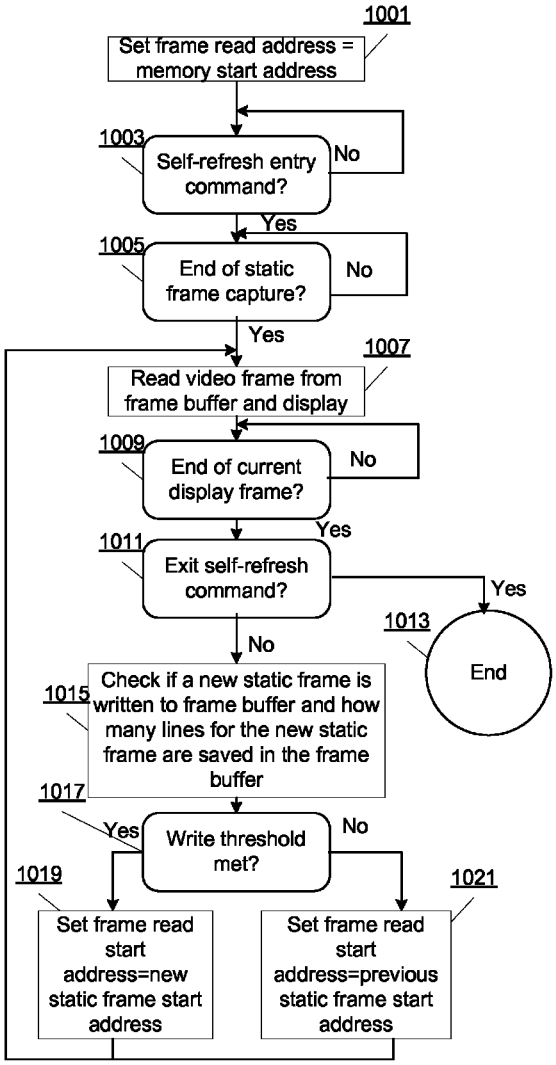
FIG. 10 illustrates a frame buffer read flow chart according to one embodiment.

FIG. 10 illustrates a frame buffer read flow chart in accordance with one example embodiment. The start frame read address is initially set 1001 equal to the memory start address. The system waits 1003 for a self-refresh entry command. After being received, the system waits for an end of static frame capture indicator 1005. The captured frame is read from the frame buffer and displayed 1007. When the captured frame has been displayed 1009, the system checks 1011 for a self-refresh exit command. If the command is received, the process ends 1013. If not, the system checks 1015 how many lines of a new frame have been written to the static frame buffer. If the write threshold is met 1017, the read start address is set 1019 to be the start address of the new static frame. If the write threshold is not met, the read start address is set 1021 to be the start address of the previous static frame.

Line Lock DPLL

Figure 11:
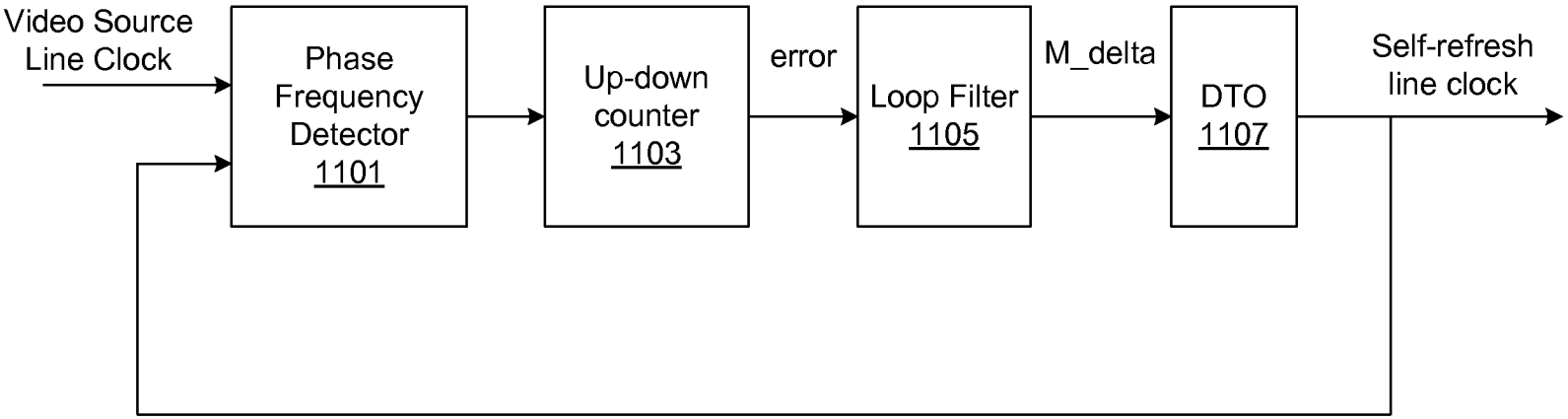
FIG. 11 illustrates a block diagram for the line lock digital phase-locked loop (DPLL) according to one embodiment.

FIG. 11 illustrates a block diagram for the line lock DPLL according to one example embodiment. The phase frequency detector 1101 determines the frequency of the input video from the source device. The up-down counter 1103 is used to control the line lock based on the discrepancy in the input and output frequency. The loop filter 1105 controls loop parameters according to design specifications and limits the amount of ripple appearing at the phase detector output that is passed through. The discrete time oscillator (DTO) 1107 generates a periodic output signal that enables the phase detector to adjust the control voltage of the oscillator based on the discrepancy between the DTO output and the input reference frequency.

The line lock DPLL will generate self-refresh line clock for local display timing generator. There are two modes for the line lock DPLL: coast mode and sync mode. In the coast mode, the DPLL does not check video line clock. It generates the line clock by pre-defined parameter only. In the sync mode, the line clock is adjusted to keep the local generated line clock sync to the line clock from video source. The local display timing generator is locked to self-refresh line clock which is generated by line lock DPLL. The static frame display block will read frame images from the frame buffer according to locally generated display timing which is generated by the local display timing generator. The static frame display block can keep the same throughput as the throughput of the static frame capture block and screen tearing is prevented.

Figure 12:
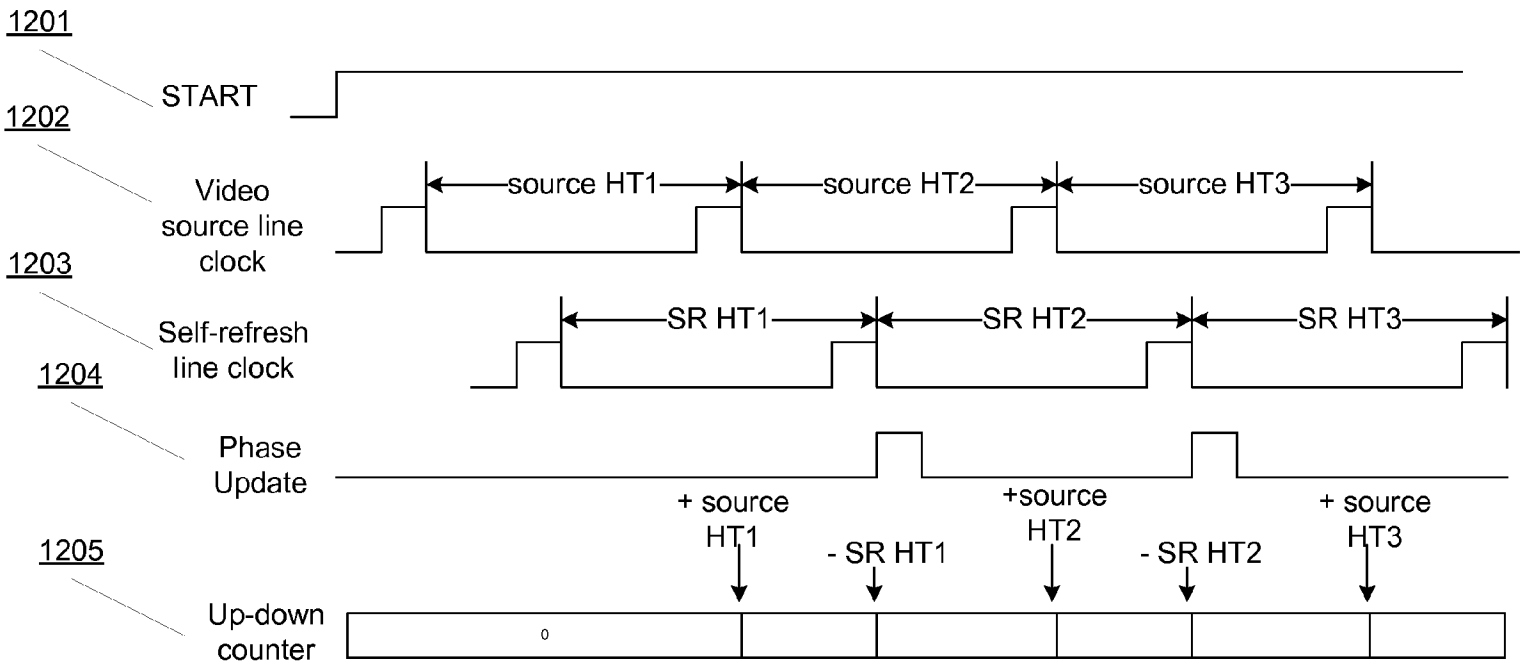
FIG. 12 illustrates a self-refresh line lock DPLL phase frequency detector and up-down counter according to one embodiment

FIG. 12 illustrates a self-refresh line lock DPLL phase frequency detector and up-down counter according to one example timing embodiment. The phase frequency detector detects the frequency difference between video source line clock and self-refresh line clock.

The first signal corresponds with a START 1201 signal. When the DPLL works in sync mode, the START 1201 signal is asserted. When DPLL enter coast mode, the START 1201 signal is de-asserted.

The next signal line is a line clock 1202. The line clock 1202 is a horizontal synchronization signal for video display.

The next signal line is self-refresh line clock 1203. It references horizontal total time (HT or HTOTAL), which is counted in number of pixels.

The next signal lines is phase update 1204. When this signal is asserted, the frequency error indication can be obtained from an up-down counter 1205.

When DPLL exits coast mode, it starts to detect the frequency error between video source line clock 1202 and self-refresh line clock 1203. A counter counts the HTOTAL for both video source line clock and self-refresh line clock. When START=0, the up-down counter is reset to 0. After one HTOTAL is counted for the video source line clock, the source HTOTAL is added to the up-down counter 1205. After one HTOTAL for self-refresh line clock is counted, the self-refresh HTOTAL is subtracted from the up-down counter.

Line counters are included for source video line clock and self-refresh video line clock. When source line counter=self-refresh line counter, the Phase Update 1204 signal is asserted and the content in the up-down counter 1205 can be used as indication for the frequency error. When source line counter−self-refresh line counter>=2, that means source line clock is too fast and the error information for up-down counter is clamped to the minimum negative value. When source line counter−self-refresh line counter<=−2, that means source line clock is too slow and the error information for up-down counter is clamped to the maximum positive value.

Figure 13:
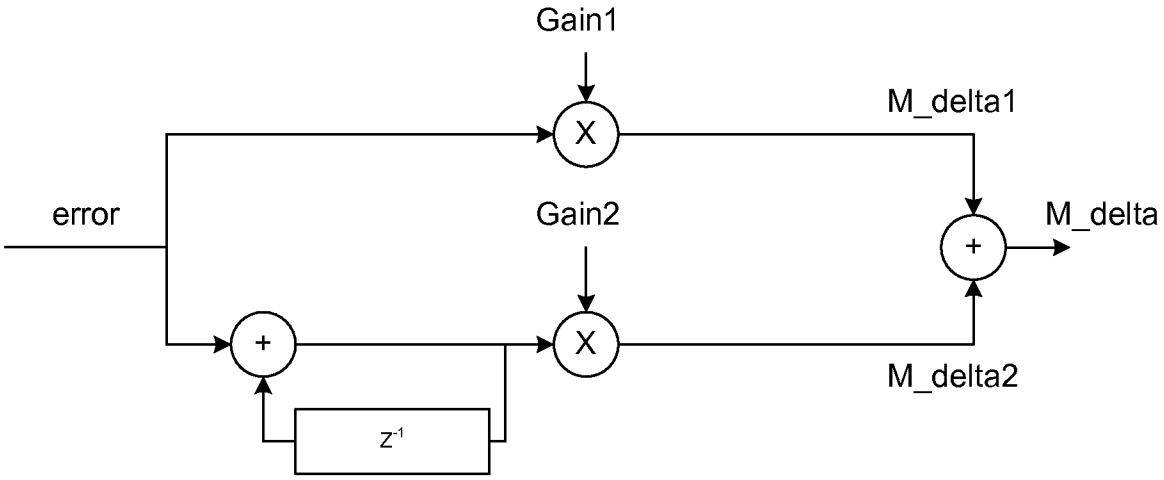
FIG. 13 illustrates the block diagram for the loop filter according to one embodiment.

The Loop Filter block will generate M_delta Control signal for DTO according to input error signals. FIG. 13 illustrates the block diagram for the loop filter in accordance with one embodiment.

In FIG. 13:

M_delta1=Gain1*error

M_delta2=Gain2*(accumulation of previous errors+current error)

M_delta=M_delta1+M_delta2

The error signal can be positive or negative and the M_delta can be positive or negative too. The DTO block is used to generate self-refresh line clock. First the adjusted pixel clock is generated according to following formula:

$$\text{Adjusted pixel clock}=(M+M_\text{delta})/M*\text{pixel clock}$$

M is a parameter for pixel clock adjustment. It is chosen according to a design requirement. With the higher parameter M, there may be a higher precision for the video clock tuning. For example, if M=4096, the adjusted video clock can be increased or decreased by 1/4096 of the original video clock. A self-refresh line clock is obtained according to following formula:

$$\text{Line clock}=\text{adjusted pixel clock}/P_HTOTAL$$

The P_HTOTAL is a parameter for horizontal total time in pixels. Normally, P_HTOTAL is set according to the self-refresh video timing format. In one embodiment, the above formulas are combined to get one formula for generating line clock as follows:

$$\begin{aligned}\text{Line clock} &= \text{adjusted pixel clock}/\text{P_HTOTAL}\\ &= (M+\text{M_delta})/M*\text{Pixel clock}/\text{P_HTOTAL}\\ &= (M+\text{M_delta})/(M*\text{P_HTOTAL})*\text{pixel clock}\\ &= P/Q*\text{pixel clock}\end{aligned}$$

A discrete time oscillator (DTO) is used in one embodiment to generate the line clock. P is the numerator of the DTO, which is equal to (M+M_delta). Q is the denominator, which is equal to (M*P_HTOTAL).

Figure 14:
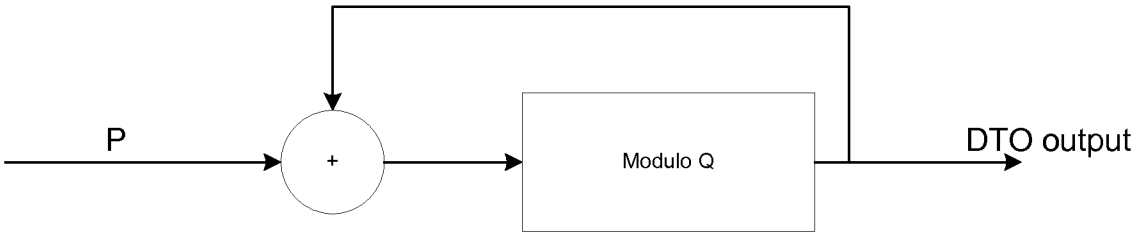
FIG. 14 is the block diagram for the discrete time oscillator (DTO) according to one embodiment.

FIG. 14 is the block diagram for the DTO in accordance with one embodiment. The self-refresh display timing generated by the local display timing generator is locked to the self-refresh line clock which is generated by the line lock DPLL. Because the self-refresh line clock is locked to video source line clock, the self-fresh display timing is at last locked to the source video line clock.

The disclosed system and method provide the solution for the memory management and self-refresh control in the self-refresh display function. Along with the line lock DPLL to adjust self-refresh line clock to match the source video line clock, screen tearing during single frame update, burst frame update and other similar frame update features can be prevented. It only need increase the frame buffer size by 2 or more lines thus can reduce the system cost. It also can reduce the power consumption. The disclosed system and method offer a flexible and general solution to all kinds of self-refresh display systems. And it also has the room to extend for any future self-refresh display system and features.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms, for example, as described in FIGS. 1 and 2. Modules may constitute either software modules (e.g., code embodied on a machine-readable medium or in a transmission signal) or hardware modules. A hardware module is tangible unit capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

The various operations of example methods described herein may be performed, at least partially, by one or more processors that are temporarily configured (e.g., by software) or permanently configured to perform the relevant operations using instructions (e.g., corresponding to the processes described in FIGS. 3, 9, and 10. Whether temporarily or permanently configured, such processors may constitute processor-implemented modules that operate to perform one or more operations or functions. The modules referred to herein may, in some example embodiments, comprise processor-implemented modules.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The phrase "in one embodiment" in various places in the specification is not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise. Upon reading this disclosure, those of skill in the art will appreciate still additional alternative structural and functional designs for a system and method for frame buffer management and self-refresh control in a self-refresh display System through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope of the disclosure.

What is claimed is:

1. A method for controlling a self-refresh display system, the method comprising:

receiving a first video frame from a video source;

storing the first video frame in a frame buffer;

outputting the first video frame for display on a screen;

receiving a second video frame from the video source;

storing a first portion of the second video frame in an unused portion of the frame buffer, the unused portion of the frame comprising a specified number of lines, the specified number of lines being less than a number of lines of the second video frame;

storing a second portion of the second video frame in the frame buffer by overwriting one or more lines of the first video frame; and outputting the second video frame for display on the screen.

2. The method of claim 1, further comprising:

receiving a command from the video source to enter self-refresh; and outputting the first video frame for display until the second video frame is received.

3. The method of claim 2, further comprising:

setting a digital phase-locked loop (DPLL) to sync mode, wherein the DPLL is configured to generate a self-refresh line clock to match a read throughput of the frame buffer with a write throughput of the frame buffer.

4. The method of claim 3, further comprising:

receiving a command from the video source to exit self-refresh; and performing a timing re-sync with the video source.

5. The method of claim 2, further comprising:

setting a MUX to output the first video frame that is stored in the frame buffer.

6. The method of claim 1, wherein the size of the frame buffer is less than the size of the first video frame and second video frame combined.

7. The method of claim 1, wherein outputting the second video frame for display occurs if a write threshold is met, the write threshold being a number of lines of the second video frame already stored in the frame buffer.

8. The method of claim 7, wherein the first video frame is again output for display if the write threshold is not met.

9. The method of claim 1, wherein the size of the frame buffer is the size of the first video frame plus the specified number of lines.

10. The method of claim 7, wherein the write threshold is half of the specified number of lines.

11. A system for controlling a self-refresh display system, the system comprising:

a video receiving module configured to receive a first video frame and a second video frame from a video source;

a static frame capture module configured to store the first video frame in a frame buffer;

a frame buffer management module configured to:

store a first portion of the second video frame in an unused portion of the frame buffer, the unused portion of the frame comprising a specified number of lines, the specified number of lines being less than a number of lines of the second video frame; and store a second portion of the second video frame in the frame buffer by overwriting one or more lines of the first video frame; and a transmitting module configured to output the first video frame and second video frame for display on a screen.

12. The system of claim 11, wherein the self-refresh display system is further configured to:

receive a command from the video source to enter self-refresh; and output the first video frame for display until the second video frame is received.

13. The system of claim 12, wherein the self-refresh display system is further configured to:

set a digital phase-locked loop (DPLL) to sync mode, wherein the DPLL is configured to generate a self-refresh line clock to match a read throughput of the frame buffer with a write throughput of the frame buffer.

14. The system of claim 13, wherein the self-refresh display system is further configured to:

receive a command from the video source to exit self-refresh; and perform a timing re-sync with the video source.

15. The system of claim 12, wherein the self-refresh display system is further configured to:

set a MUX to output the first video frame that is stored in the frame buffer.

16. The system of claim 11, wherein the size of the frame buffer is less than the size of the first video frame and second video frame combined.

17. The system of claim 11, wherein outputting the second video frame for display occurs if a write threshold is met, the write threshold being a number of lines of the second video frame already stored in the frame buffer.

18. The system of claim 17, wherein the first video frame is again output for display if the write threshold is not met.

19. The system of claim 17, wherein the write threshold is half of the specified number of lines.

20. The system of claim 11, wherein the size of the frame buffer is the size of the first video frame plus the specified number of lines.

* * * * *